US010843023B1

(12) United States Patent
Abelardo

(10) Patent No.: US 10,843,023 B1
(45) Date of Patent: Nov. 24, 2020

(54) EXERCISE AND STRETCHING DEVICE

(71) Applicant: Anthony Abelardo, Tinton Falls, NJ (US)

(72) Inventor: Anthony Abelardo, Tinton Falls, NJ (US)

( * ) Notice: Subject to any disclaimer, the term of this patent is extended or adjusted under 35 U.S.C. 154(b) by 50 days.

(21) Appl. No.: 16/378,695

(22) Filed: Apr. 9, 2019

(51) Int. Cl.

| | |
|---|---|
| ***A63B 21/00*** | (2006.01) |
| ***A63B 21/055*** | (2006.01) |
| *A61H 1/02* | (2006.01) |
| *A63B 23/00* | (2006.01) |
| *A63B 21/002* | (2006.01) |
| *A63B 21/02* | (2006.01) |

(52) U.S. Cl.
CPC .. *A63B 21/00185* (2013.01); *A63B 21/00061* (2013.01); *A63B 21/0552* (2013.01); *A61H 1/02* (2013.01); *A63B 21/0004* (2013.01); *A63B 21/0023* (2013.01); *A63B 21/00043* (2013.01); *A63B 21/028* (2013.01); *A63B 2023/006* (2013.01)

(58) Field of Classification Search
CPC . A63B 21/00189; A63B 21/028; A63B 21/04; A63B 21/0555; A63B 21/0557; A63B 21/00061; A63B 21/00185; A63B 21/0023; A63B 21/0552; A63B 21/4023; A63B 2023/006; A61H 1/02
See application file for complete search history.

(56) References Cited

U.S. PATENT DOCUMENTS

| | | | | |
|---|---|---|---|---|
| 1,810,255 | A * | 6/1931 | Poulos | A63B 21/0004 482/126 |
| 6,071,218 | A * | 6/2000 | Tepperberg | A63B 21/0004 482/121 |
| 6,450,930 | B1 * | 9/2002 | Kroke | A61H 1/0255 482/121 |
| 7,195,434 | B1 * | 3/2007 | Kuo | B60P 7/0876 410/118 |
| 8,303,471 | B2 * | 11/2012 | Musachio | A63B 23/1254 482/121 |
| 8,343,018 | B2 * | 1/2013 | Moulton | A63B 23/035 482/91 |
| 9,050,493 | B2 | 6/2015 | Perez | |
| 9,259,606 | B2 | 2/2016 | Wolan | |
| 9,675,830 | B2 * | 6/2017 | Holland | A61H 15/00 |
| 9,675,835 | B1 | 6/2017 | Abramovich | |

(Continued)

FOREIGN PATENT DOCUMENTS

WO 2017165763 9/2017

*Primary Examiner* — Megan Anderson

(57) ABSTRACT

The exercise and stretching device is a semi-rigid structure. The exercise and stretching device has an elastic nature. The exercise and stretching device is configured for use in physical training. The semi-rigid structure of the exercise and stretching device generates a resistance used during physical training. The exercise and stretching device forms a ladder-shaped framework. The exercise and stretching device is an openwork structure. The exercise and stretching device comprises a plurality of master rails, a plurality of supplemental structures, and a plurality of rungs. The plurality of rungs interconnect the plurality of master rails. The plurality of rungs interconnect the plurality of supplemental structures. The plurality of rungs interconnect the plurality of master rails and the plurality of supplemental structures.

18 Claims, 4 Drawing Sheets

(56) References Cited

U.S. PATENT DOCUMENTS

| | | | |
|---|---|---|---|
| 9,868,013 | B1 | 1/2018 | Leverenz |
| 10,010,146 | B2 | 7/2018 | Moore |
| 2004/0144465 | A1 | 7/2004 | Tiar |
| 2013/0331242 | A1 | 12/2013 | Wilson |
| 2016/0082306 | A1 | 3/2016 | Williams |
| 2018/0339181 | A1 | 11/2018 | Weisz |

* cited by examiner

EXERCISE AND STRETCHING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of sports and apparatus for physical training including exercising apparatus that works against a counterforce, more specifically, an exercise apparatus with a mechanical means for varying the resistance with replaceable resistance units. (A63B21/00061)

SUMMARY OF INVENTION

The exercise and stretching device is a semi-rigid structure. The exercise and stretching device has an elastic nature. The exercise and stretching device is configured for use in physical training. The semi-rigid structure of the exercise and stretching device generates a resistance used during physical training. The exercise and stretching device forms a ladder-shaped framework. The exercise and stretching device is an openwork structure. The exercise and stretching device comprises a plurality of master rails, a plurality of supplemental structures, and a plurality of rungs. The plurality of rungs interconnect the plurality of master rails. The plurality of rungs interconnect the plurality of supplemental structures. The plurality of rungs interconnect the plurality of master rails and the plurality of supplemental structures.

These together with additional objects, features and advantages of the exercise and stretching device will be readily apparent to those of ordinary skill in the art upon reading the following detailed description of the presently preferred, but nonetheless illustrative, embodiments when taken in conjunction with the accompanying drawings.

In this respect, before explaining the current embodiments of the exercise and stretching device in detail, it is to be understood that the exercise and stretching device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the exercise and stretching device.

It is therefore important that the claims be regarded as including such equivalent construction insofar as they do not depart from the spirit and scope of the exercise and stretching device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
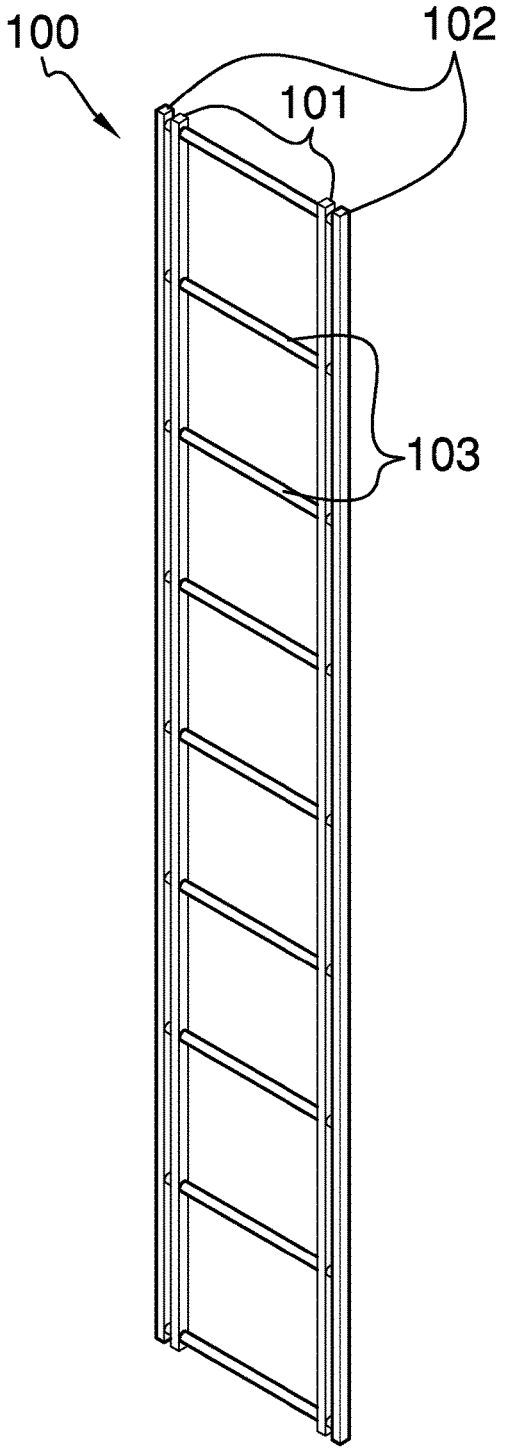
FIG. 1 is a perspective view of an embodiment of the disclosure.
Figure 2:
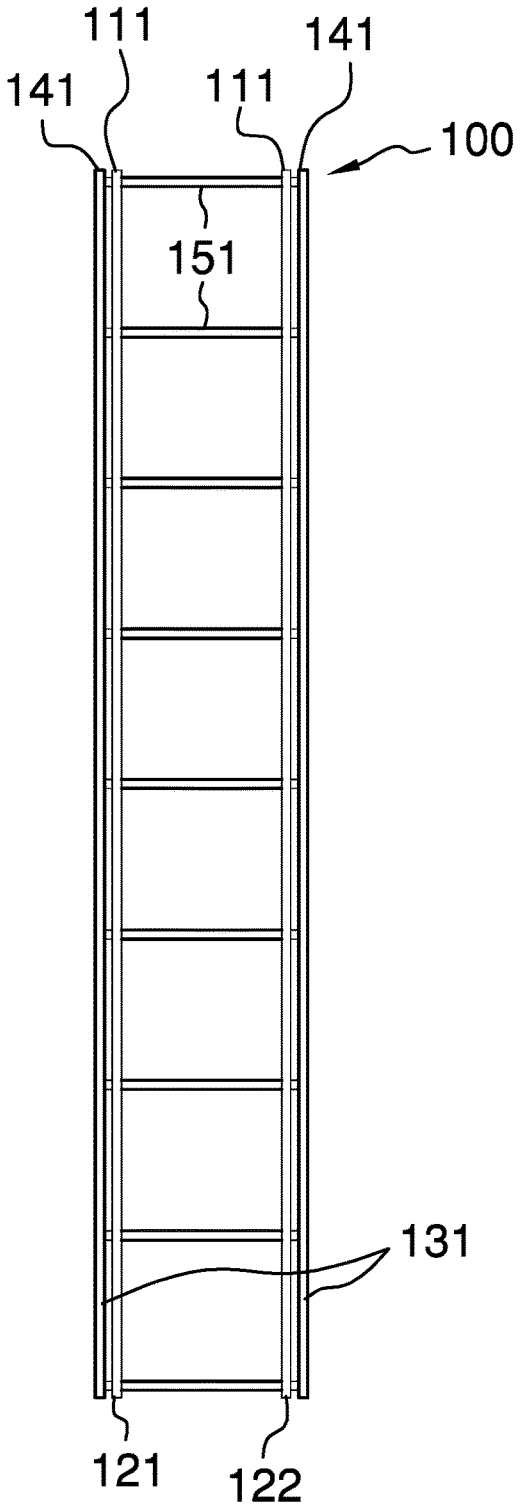
FIG. 2 is a front view of an embodiment of the disclosure.
Figure 3:
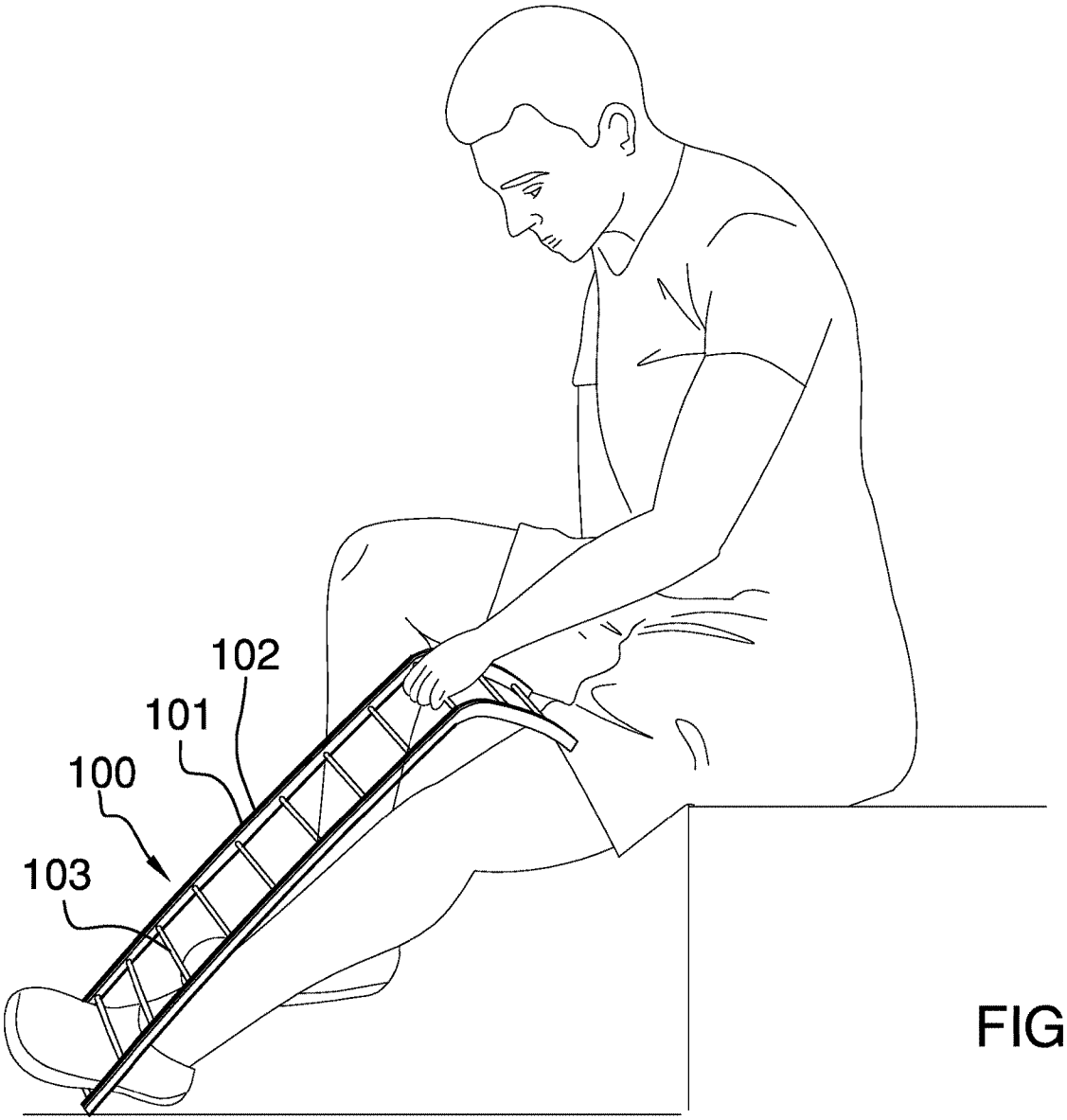
FIG. 3 is an in-use view of an embodiment of the disclosure.
Figure 4:
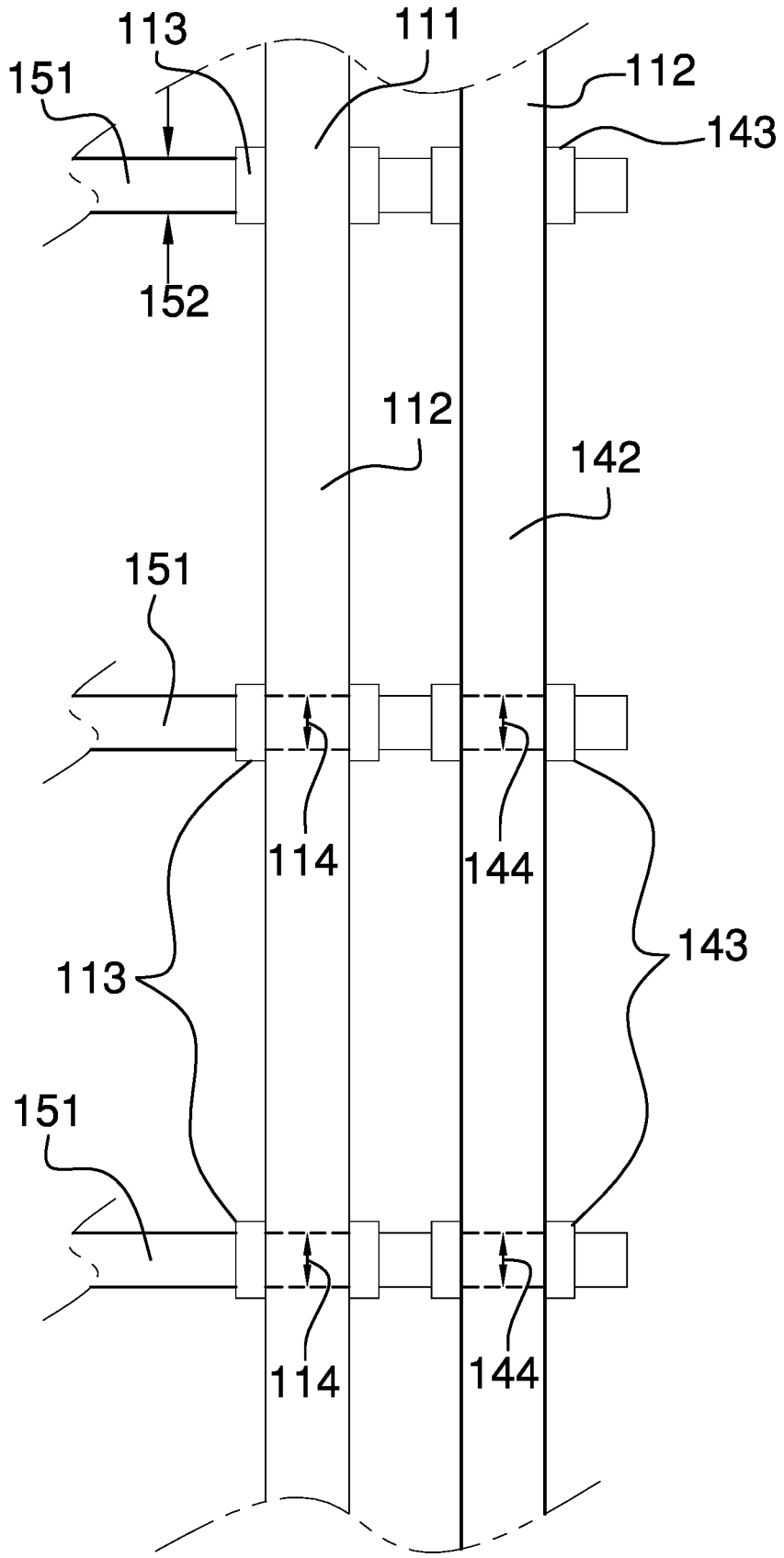
FIG. 4 is a detail view of an embodiment of the disclosure.
Figure 5:
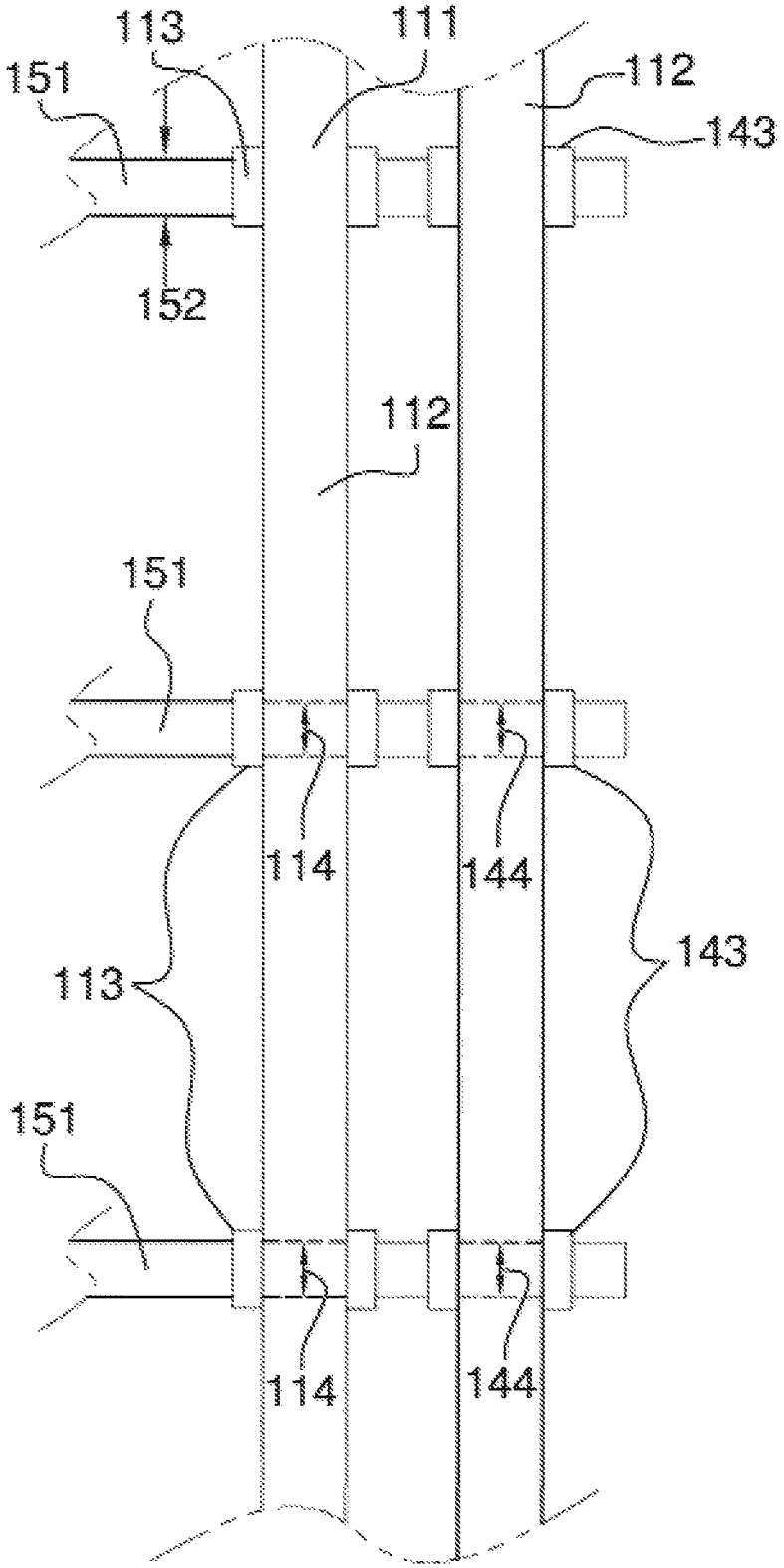
FIG. 5 is a detail view of an embodiment of the disclosure.

Detailed reference will now be made to one or more potential embodiments of the disclosure, which are illustrated in FIGS. 1 through 5.

The exercise and stretching device 100 (hereinafter invention) is a semi-rigid structure. The invention 100 has an elastic nature. The invention 100 is configured for use in physical training. The semi-rigid structure of the invention 100 generates a resistance used during physical training. The invention 100 forms a ladder-shaped framework. The invention 100 is an openwork structure. The invention 100 comprises a plurality of master rails 101, a plurality of supplemental structures 102, and a plurality of rungs 103. The plurality of rungs 103 interconnect the plurality of master rails 101. The plurality of rungs 103 interconnect the plurality of supplemental structures 102. The plurality of rungs 103 interconnect the plurality of master rails 101 and the plurality of supplemental structures 102.

Each of the plurality of master rails 101 forms the rails of the ladder-shaped framework of the invention 100. Each of the plurality of master rails 101 is a semi-rigid structure with an elastic nature. Each of the plurality of master rails 101 has a prism structure. Each of the plurality of master rails 101 are identical when the plurality of master rails 101 are each in their relaxed shape. Each of the plurality of master rails 101 are interconnected using the plurality of rungs 103.

The center axes of each of the plurality of master rails 101 are perpendicular to the center axes of the plurality of rungs 103 when the plurality of master rails 101 are stretched to maximum deformation in the direction of the center axis of each of the plurality of master rails 101. The center axes of each of the plurality of master rails 101 are parallel to each other when the plurality of master rails 101 are stretched to maximum deformation in the direction of the center axis of each of the plurality of master rails 101.

Each of the plurality of master rails 101 is further defined with a modulus. The modulus is defined in greater detail elsewhere in this disclosure.

The plurality of master rails 101 comprises a collection of individual master rail 111. Each individual master rail 111 selected from the plurality of master rails 101 is identical. Each individual master rail 111 always forms a rail of the ladder-shaped framework of the invention 100. Each individual master rail 111 is a semi-rigid structure with an elastic nature. Each individual master rail 111 is further defined with a modulus. The modulus of each individual master rail 111 is identical. Each individual master rail 111 provides a portion of the resistance presented by the invention 100 during physical training. Each individual master rail 111 comprises a primary elastic band 112 and a plurality of primary grommets 113.

The primary elastic band 112 is a polyurethane structure. The primary elastic band 112 is formed in a prism shape. The primary elastic band 112 is configured to be stretched in a direction parallel to the center axis of the prism shape of the primary elastic band 112. The primary elastic band 112 is further defined with a modulus. The modulus of the primary elastic band 112 provides a portion of the resistance presented by the invention 100 during physical training.

The primary elastic band 112 acts as a spring. Specifically, when a force is applied to both ends of the primary elastic band 112 in a direction parallel to the center axis of the primary elastic band 112, the applied force elongates the span of the end to end length the primary elastic band 112 in the direction parallel to the center axis of the primary elastic band 112. The elasticity of the primary elastic band 112 creates a force that opposes the displacement created by the applied force. The elasticity of the primary elastic band 112 returns the primary elastic band 112 to its relaxed shape.

Each of the plurality of primary grommets 113 mounts in the primary elastic band 112. Each of the plurality of primary grommets 113 forms a negative space that creates a radial aperture through the lateral faces of the prism structure of the primary elastic band 112. Each of the plurality of primary grommets 113 is identical. Each of the plurality of primary grommets 113 are distributed evenly along the center axis of the prism structure of the primary elastic band 112. The negative space formed each of the plurality of primary grommets 113 has a prism-shaped.

Each of the plurality of primary grommets 113 is further defined with a primary inner diameter 114. The primary inner diameter 114 of each of the plurality of primary grommets 113 is sized to receive an individual rung 151 selected from the plurality of rungs 103. The inner diameter is defined in greater detail elsewhere in this disclosure.

The plurality of master rails 101 further comprises a first master rail 121 and a second master rail 122.

The first master rail 121 is an individual master rail 111 selected from the plurality of master rails 101. The first master rail 121 always form a rail that is incorporated into the ladder-shaped framework of the invention 100. The position of the first master rail 121 is always proximal to the center of any individual rung 151 selected from the plurality of rungs 103 relative to any individual supplemental rail 141 selected from the plurality of supplemental structures 102 that is attached to the ladder-shaped framework of the plurality of master rails 101.

The second master rail 122 is an individual master rail 111 selected from the plurality of master rails 101. The second master rail 122 always form a rail that is incorporated into the ladder-shaped framework of the invention 100. The position of the second master rail 122 is always proximal to the center of any individual rung 151 selected from the plurality of rungs 103 relative to any individual supplemental rail 141 selected from the plurality of supplemental structures 102 that is attached to the ladder-shaped framework of the plurality of master rails 101.

Each of the plurality of supplemental structures 102 forms additional rails of the ladder-shaped framework of the invention 100. Each of the plurality of supplemental structures 102 is a semi-rigid structure with an elastic nature. Each of the plurality of supplemental structures 102 has a prism structure. The form factor of each of the plurality of supplemental structures 102 are identical when the plurality of supplemental structures 102 are each in their relaxed shape. Each of the plurality of supplemental structures 102 are interconnected using the plurality of rungs 103.

The center axes of each of the plurality of supplemental structures 102 are perpendicular to the center axes of the plurality of rungs 103 when the plurality of supplemental structures 102 are stretched to maximum deformation in the direction of the center axis of each of the plurality of supplemental structures 102. The center axes of each of the plurality of supplemental structures 102 are parallel to each other when the plurality of supplemental structures 102 are stretched to maximum deformation in the direction of the center axis of each of the plurality of supplemental structures 102.

Each of the plurality of supplemental structures 102 is further defined with a modulus. The modulus is defined in greater detail elsewhere in this disclosure.

The plurality of supplemental structures 102 increases the resistance provided by the plurality of master rails 101 during physical training. The position of the center axes of each of the plurality of supplemental structures 102 is parallel to the center axes of each of the plurality of master rails 101 such that the modulus of each of the plurality of supplemental structures 102 is added to the modulus of each of the plurality of master rails 101 in a manner that increases the overall resistance presented by the invention 100 during physical training.

The plurality of supplemental structures 102 is organized into a collection of sub-pluralities of supplemental rail pairs 131. The sub-plurality of supplemental rail pairs 131 comprises a collection of individual supplemental rails 141. The organization and purpose of the sub-pluralities of supplemental rail pairs 131 is described after the description of the individual supplemental rails 141

Each individual supplemental rail 141 is optionally used to supplement the resistance to physical training that is provided by the plurality of master rails 101. Each individual supplemental rail 141 selected from the plurality of supplemental structures 102 has an identical form factor. Each individual supplemental rail 141 forms a rail of the ladder-shaped framework of the invention 100. Each individual supplemental rail 141 is a semi-rigid structure with an elastic nature. Each individual supplemental rail 141 is further defined with a modulus. The modulus of each individual supplemental rail 141 is not identical. Each individual supplemental rail 141 provides a portion of the resistance presented by the invention 100 during physical training. Each individual supplemental rail 141 comprises a supplemental elastic band 142 and a plurality of supplemental grommets 143.

The supplemental elastic band 142 is a polyurethane structure. The supplemental elastic band 142 is formed in a prism shape. The supplemental elastic band 142 is configured to be stretched in a direction parallel to the center axis of the prism shape of the supplemental elastic band 142. The supplemental elastic band 142 is further defined with a modulus. The modulus of the supplemental elastic band 142 provides a portion of the resistance presented by the invention 100 during physical training.

The supplemental elastic band 142 acts as a spring. Specifically, when a force is applied to both ends of the supplemental elastic band 142 in a direction parallel to the center axis of the supplemental elastic band 142, the applied force elongates the span of the end to end length the supplemental elastic band 142 in the direction parallel to the center axis of the supplemental elastic band 142. The elasticity of the supplemental elastic band 142 creates a force that opposes the displacement created by the applied force. The elasticity of the supplemental elastic band 142 returns the supplemental elastic band 142 to its relaxed shape.

Each of the plurality of supplemental grommets 143 mounts in the supplemental elastic band 142. Each of the plurality of supplemental grommets 143 forms a negative space that creates a radial aperture through the lateral faces of the prism structure of the supplemental elastic band 142. Each of the plurality of supplemental grommets 143 is identical. Each of the plurality of supplemental grommets 143 are distributed evenly along the center axis of the prism structure of the supplemental elastic band 142. The negative space formed each of the plurality of supplemental grommets 143 has a prism-shaped.

Each of the plurality of supplemental grommets 143 is further defined with a supplemental inner diameter 144. The supplemental inner diameter 144 of each of the plurality of supplemental grommets 143 is sized to receive an individual rung 151 selected from the plurality of rungs 103. The inner diameter is defined in greater detail elsewhere in this disclosure.

The sub-plurality of supplemental rail pairs 131 is formed from a pair of individual supplemental rails 141 referred to as the first individual supplemental rail 141 and the second individual supplemental rail 141. The modulus of the first individual supplemental rail 141 is identical to the modulus of the second supplemental elastic band 142. The form factor of the individual supplemental rail 141 is identical to the form factor of the second supplemental elastic band 142. The difference between any first sub-plurality of supplemental rail pairs 131 selected from the plurality of supplemental structures 102 and any second sub-plurality of supplemental rail pairs 131 selected from the plurality of supplemental structures 102 is the modulus of each individual supplemental rail 141 contained in the sub-plurality of supplemental rail pairs 131.

The plurality of supplemental structures 102 are added as individual sub-plurality of supplemental rail pairs 131 to the ladder-shaped framework of the invention 100 instead of as individual supplemental rails 141. Each of the plurality of rungs 103 is a rigid structure.

Each of the plurality of rungs 103 has a prism structure. Each of the plurality of rungs 103 attaches to each of the plurality of master rails 101 when the invention 100 is in use. Each of the plurality of rungs 103 attaches to each of the plurality of supplemental structures 102 when the plurality of supplemental structures 102 are added as rails to the ladder-shaped framework of the invention 100. Each of the plurality of rungs 103 are identical.

The plurality of rungs 103 comprises a collection of individual rungs 151. Each individual rung 151 selected from the plurality of rungs 103 is identical. Each individual rung 151 is a rigid structure. Each individual rung 151 interconnects the plurality of master rails 101. Each individual rung 151 interconnects the plurality of supplemental structures 102. The individual rung 151 interconnects the plurality of master rails 101 to the plurality of supplemental structures 102. The individual rung 151 forms a grip that allows the invention 100 to be stretched in the direction of the center axes of the plurality of master rails 101 during physical training.

Each individual rung 151 is geometrically similar to each primary grommet selected from the plurality of primary grommets 113. Each individual rung 151 is geometrically similar to each supplemental grommet selected from the plurality of grommet grommets 143.

The individual rung 151 is further defined with an outer diameter 152. The outer diameter 152 of each of the individual rung 151 is lesser than the primary inner diameter 114 of each of the plurality of primary grommets 113 such that the individual rung 151 will insert through any primary grommet selected from the plurality of primary grommets 113. The outer diameter 152 of each of the individual rung 151 is lesser than the supplemental inner diameter 144 of each of the plurality of supplemental grommets 143 such that the individual rung 151 will insert through any supplemental grommet selected from the plurality of supplemental grommets 143.

To assemble the invention 100 each individual rung 151 selected from the plurality of rungs 103 simultaneously inserts through: a) a primary grommet selected from the plurality of primary grommets 113 of each of the plurality of master rails 101; and, b) a secondary grommet selected from the plurality of supplemental grommets 143 of each individual supplemental rail 141 contained in each sub-plurality of supplemental rail pairs selected from the plurality of supplemental structures 102 that attaches to the ladder-shaped framework of the invention 100.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Carbamate: As used in this disclosure, a carbamate is a functional group consisting of an O—(C=O)—N structure. Carbamate is informally referred to as urethane.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter.

Diametrically Opposed: As used in this disclosure, diametrically opposed is a term that describes the locations of a first object and a second object located at opposite ends of a diameter drawn through a third object. The term diametric opposition can also be used to describe this relationship.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Elastic Band: As used in this disclosure, an elastic band is a loop of textile that is formed using elastic material that can stretched. Alternatively, the elastic band can be a sheeting that is formed from latex, spandex, or an elastic plastic film that can be stretched.

Form Factor: As used in this disclosure, the term form factor refers to the size and shape of an object.

Framework: As used in this disclosure, a framework refers to the substructure of an object that carries the load path of the object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grip: As used in this disclosure, a grip is an accommodation formed on or within an object that allows the object to be grasped or manipulated by a hand.

Grommet: As used in this disclosure, a grommet is an eyelet placed in a hole in a textile, sheeting, or panel that protects a structure passed through the grommet and that further protects the textile, sheeting, or panel from being torn.

Ladder: As used in this disclosure, a ladder is a climbing structure formed from rails and rungs used by an individual to change their elevation. The rails are joined by the rungs. The rungs are mounted horizontally. The rails provide the vertical support for the ladder. The rungs form the step structures used to change elevation.

Modulus: As used in this disclosure, the modulus of an elastomeric material is a function that describes the percentage change in the span of the elastomeric material as a function of the force applied to elastomeric material. When comparing modulus, a larger modulus is taken to imply that an increase in force is required to get the same percentage change in the elastomeric material.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Openwork: As used in this disclosure, the term open work is used to describe a structure, often a surface, which is formed with one or more openings that allow for visibility and fluid flow through the structure. Wrought work and meshes are forms of openwork.

Orientation: As used in this disclosure, orientation refers to the positioning of a first object relative to: 1) a second object; or, 2) a fixed position, location, or direction.

Perimeter: As used in this disclosure, a perimeter is one or more curved or straight lines that bounds an enclosed area on a plane or surface. The perimeter of a circle is commonly referred to as a circumference.

Polyurethane: As used in this disclosure, a polyurethane is a copolymer wherein the one or more monomer chains are linked together carbamates.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Radial: As used in this disclosure, the term radial refers to a direction that: 1) is perpendicular to an identified central axis; or, 2) projects away from a center point.

Relaxed Shape: As used in this disclosure, a structure is considered to be in its relaxed state when no shear, strain, or torsional forces are being applied to the structure.

Semi-Rigid Structure: As used in this disclosure, a semi-rigid structure is a solid structure that is stiff but not wholly inflexible and that will deform under force before breaking. A semi-rigid structure may or may not behave with an elastic nature in that a semi-rigid structure need not return to its relaxed shape.

Shaft: As used in this disclosure, a shaft is a long, narrow and rigid prism structure that is used as: 1) a structural element of a larger object; or 2) as a grip or lever for a handle. Shafts often have a cylindrical shape.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An exercise and stretching device comprising:

a plurality of master rails, a plurality of supplemental structures, and a plurality of rungs;

wherein the plurality of rungs interconnect the plurality of master rails;

wherein the plurality of rungs interconnect the plurality of supplemental structures;

wherein the plurality of rungs interconnect the plurality of master rails and the plurality of supplemental structures;

wherein the exercise and stretching device is a semi-rigid structure;

wherein the exercise and stretching device has an elastic nature;

wherein the semi-rigid structure of the exercise and stretching device generates a resistance;

wherein the exercise and stretching device forms a ladder-shaped framework;

wherein the exercise and stretching device is an openwork structure;

wherein each of the plurality of master rails forms the rails of the ladder-shaped framework of the exercise and stretching device;

wherein each of the plurality of master rails is a semi-rigid structure with an elastic nature;

wherein each of the plurality of master rails has a prism structure;

wherein each of the plurality of master rails are identical when the plurality of master rails are each in their relaxed shape;

wherein each of the plurality of master rails is further defined with a modulus.

2. The exercise and stretching device according to claim 1 wherein each of the plurality of supplemental structures is a semi-rigid structure with an elastic nature;

wherein each of the plurality of supplemental structures has a prism structure;

wherein the form factor of each of the plurality of supplemental structures are identical when the plurality of supplemental structures are each in their relaxed shape;

wherein each of the plurality of supplemental structures is further defined with a modulus;

wherein the plurality of supplemental structures increases the resistance provided by the plurality of master rails;

wherein the plurality of supplemental structures is organized into a collection of sub-pluralities of supplemental rail pairs;

wherein the sub-plurality of supplemental rail pairs comprises a collection of individual supplemental rails.

3. The exercise and stretching device according to claim 2 wherein each of the plurality of rungs is a rigid structure;

wherein each of the plurality of rungs has a prism structure.

4. The exercise and stretching device according to claim 3 wherein a center axes of the prism structure of each of the plurality of master rails are perpendicular to a center axes of the prism structure of each of the plurality of rungs when the plurality of master rails are stretched to maximum deformation in the direction of the center axis of each of the plurality of master rails;

wherein the center axes of each of the plurality of master rails are parallel to each other when the plurality of master rails are stretched to maximum deformation in the direction of the center axis of each of the plurality of master rails.

5. The exercise and stretching device according to claim 4 wherein the plurality of master rails comprises a collection of individual master rails;

wherein each individual master rail selected from the plurality of master rails is identical;

wherein each individual master rail always forms a rail of the ladder-shaped framework of the exercise and stretching device.

6. The exercise and stretching device according to claim 5 wherein a center axes of each of the plurality of supplemental structures are perpendicular to the center axes of the plurality of rungs when the plurality of supplemental structures are stretched to maximum deformation in the direction of the center axis of each of the plurality of supplemental structures;

wherein the center axes of each of the plurality of supplemental structures are parallel to each other when the plurality of supplemental structures are stretched to maximum deformation in the direction of the center axis of each of the plurality of supplemental structures;

wherein the position of the center axes of each of the plurality of supplemental structures is parallel to the center axes of each of the plurality of master rails.

7. The exercise and stretching device according to claim 6 wherein each individual master rail of the plurality of master rails is a semi-rigid structure with an elastic nature;

wherein each individual master rail of the plurality of master rails is further defined with a modulus;

wherein the modulus of each individual master rail of the plurality of master rails is identical;

wherein each individual master rail of the plurality of master rails provides a portion of the resistance presented by the exercise and stretching device.

8. The exercise and stretching device according to claim 7 wherein each individual master rail of the plurality of master rails comprises a primary elastic band and a plurality of primary grommets;

wherein each of the plurality of primary grommets mounts in the primary elastic band.

9. The exercise and stretching device according to claim 8 wherein each of the primary elastic bands is a polyurethane structure;

wherein each of the primary elastic bands is formed in a prism shape;

wherein each of the primary elastic bands configured to be stretched in a direction parallel to the center axis of the prism shape of the primary elastic band;

wherein each of the primary elastic bands further defined with a modulus.

10. The exercise and stretching device according to claim 9 wherein each of the plurality of primary grommets forms a negative space that creates a radial aperture through the lateral faces of the prism structure of the primary elastic band;

wherein each of the plurality of primary grommets is identical;

wherein each of the plurality of primary grommets are distributed evenly along the center axis of the prism structure of the primary elastic band;

wherein the negative space formed each of the plurality of primary grommets has a prism-shaped;

wherein each of the plurality of primary grommets is further defined with a primary inner diameter;

wherein the primary inner diameter of each of the plurality of primary grommets is sized to receive an individual rung selected from the plurality of rungs.

11. The exercise and stretching device according to claim 10 wherein the plurality of master rails further comprises a first master rail and a second master rail;

wherein the first master rail is an individual master rail selected from the plurality of master rails;

wherein the first master rail always forms a rail that is incorporated into the ladder-shaped framework of the exercise and stretching device;

wherein the second master rail is an individual master rail selected from the plurality of master rails;

wherein the second master rail always forms a rail that is incorporated into the ladder-shaped framework of the exercise and stretching device;

wherein the position of the first master rail is always proximal to the center of any individual rung selected from the plurality of rungs relative to any individual supplemental rail selected from the plurality of supplemental structures that is attached to the ladder-shaped framework of the plurality of master rails;

wherein the position of the second master rail is always proximal to the center of any individual rung selected from the plurality of rungs relative to any individual supplemental rail selected from the plurality of supplemental structures that is attached to the ladder-shaped framework of the plurality of master rails.

12. The exercise and stretching device according to claim 11 wherein each individual supplemental rail selected from the plurality of supplemental structures has an identical form factor;

wherein each individual supplemental rail of the plurality of supplemental structures forms a rail of the ladder-shaped framework of the exercise and stretching device;

wherein each individual supplemental rail of the plurality of supplemental structures is a semi-rigid structure with an elastic nature;

wherein each individual supplemental rail of the plurality of supplemental structures is further defined with a modulus.

13. The exercise and stretching device according to claim 12 wherein each individual supplemental rail of the plurality of supplemental structures comprises a supplemental elastic band and a plurality of supplemental grommets;

wherein the plurality of supplemental grommets are installed in the supplemental elastic band.

14. The exercise and stretching device according to claim 13 wherein each of the supplemental elastic bands is a polyurethane structure;

wherein each of the supplemental elastic bands is formed in a prism shape;

wherein each of the supplemental elastic bands is configured to be stretched in a direction parallel to the center axis of the prism shape of the supplemental elastic band;

wherein each of the supplemental elastic bands is further defined with a modulus.

15. The exercise and stretching device according to claim 14 wherein each of the plurality of supplemental grommets mounts in the supplemental elastic band;

wherein each of the plurality of supplemental grommets forms a negative space that creates a radial aperture through the lateral faces of the prism structure of the supplemental elastic band;

wherein each of the plurality of supplemental grommets is identical;

wherein each of the plurality of supplemental grommets are distributed evenly along the center axis of the prism structure of the supplemental elastic band;

wherein the negative space formed by each of the plurality of supplemental grommets has a prism-shaped;

wherein each of the plurality of supplemental grommets is further defined with a supplemental inner diameter;

wherein the supplemental inner diameter of each of the plurality of supplemental grommets is sized to receive an individual rung selected from the plurality of rungs.

16. The exercise and stretching device according to claim 15 wherein the sub-plurality of supplemental rail pairs is formed from a pair of individual supplemental rails referred to as the first individual supplemental rail and the second individual supplemental rail;

wherein the modulus of the first individual supplemental rail is identical to the modulus of the second supplemental elastic band;

wherein the form factor of the individual supplemental rail is identical to the form factor of the second supplemental elastic band;

wherein the difference between any first sub-plurality of supplemental rail pairs selected from the plurality of supplemental structures and any second sub-plurality of supplemental rail pairs selected from the plurality of supplemental structures is the modulus of each individual supplemental rail contained in the sub-plurality of supplemental rail pairs;

wherein the plurality of supplemental structures are added as individual sub-plurality of supplemental rail pairs to the ladder-shaped framework of the exercise and stretching device instead of as individual supplemental rails.

17. The exercise and stretching device according to claim 16 wherein the plurality of rungs comprises a collection of individual rungs;

wherein each individual rung selected from the plurality of rungs is identical;

wherein each individual rung of the plurality of rungs is a rigid structure;

wherein each individual rung of the plurality of rungs is geometrically similar to each primary grommet selected from the plurality of primary grommets;

wherein each individual rung of the plurality of rungs is geometrically similar to each supplemental grommet selected from the plurality of grommet grommets;

wherein each of the individual rungs forms a grip that allows the exercise and stretching device to be stretched in the direction of the center axes of the plurality of master rails;

wherein each of the individual rungs are further defined with an outer diameter.

18. The exercise and stretching device according to claim 16 wherein the outer diameter of each of the individual rungs is lesser than the primary inner diameter of each of the plurality of primary grommets such that the individual rungs will insert through any primary grommet selected from the plurality of primary grommets;

wherein the outer diameter of each of the individual rungs is lesser than the supplemental inner diameter of each of the plurality of supplemental grommets such that the individual rung will insert through any supplemental grommet selected from the plurality of supplemental grommets.

* * * * *